US007212194B2

(12) United States Patent
Nagaoka

(10) Patent No.: US 7,212,194 B2
(45) Date of Patent: May 1, 2007

(54) DRIVE APPARATUS FOR A DISPLAY PANEL

(75) Inventor: Shiro Nagaoka, Fukuroi (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 462 days.

(21) Appl. No.: 10/402,958

(22) Filed: Apr. 1, 2003

(65) Prior Publication Data

US 2003/0184537 A1 Oct. 2, 2003

(30) Foreign Application Priority Data

Apr. 1, 2002 (JP) ..... 2002-098273

(51) Int. Cl.
*G09G 3/10* (2006.01)

(52) U.S. Cl. ..... 345/204; 345/60

(58) Field of Classification Search ..... 345/204, 345/60

See application file for complete search history.

(56) References Cited

U.S. PATENT DOCUMENTS

| | | | | |
|---|---|---|---|---|
| 5,654,728 A | * | 8/1997 | Kanazawa et al. | 345/68 |
| 6,111,555 A | | 8/2000 | Haas | |
| 6,304,038 B1 | | 10/2001 | Ide et al. | |
| 6,559,603 B2 | * | 5/2003 | Iwami | 315/169.1 |

FOREIGN PATENT DOCUMENTS

| | | |
|---|---|---|
| EP | 0420518 A2 | 4/1991 |
| EP | 0704834 A1 | 4/1996 |
| EP | 0895218 A1 | 2/1999 |
| EP | 1022716 A2 | 7/2000 |

* cited by examiner

*Primary Examiner*—Sumati Lefkowitz
*Assistant Examiner*—Tammy Pham
(74) *Attorney, Agent, or Firm*—Sughrue Mion, PLLC

(57) ABSTRACT

A display panel includes row and column electrodes. Capacitive light-emitting elements are provided at crossing portions of the row and column electrodes. A drive unit drives the display panel in response to an input image signal. The drive unit includes a column electrode driver for applying a pixel data pulse to each of the column electrodes. The pixel data pulse has a pulse voltage corresponding to pixel data derived from the input image signal. The column electrode driver includes a power source circuit for generating a resonance pulse power source voltage having a predetermined resonance amplitude. The power source circuit also applies the. resonance pulse power source voltage to a power source line. The column electrode driver also includes a pixel data pulse generator circuit for selectively connecting the column electrodes with the power source line based on the pixel data, to apply the pixel data pulse to the column electrodes. The column electrode driver also includes a DC drive prevention circuit for forcibly grounding the power source line while the resonance pulse power source voltage is dropping, if an intermediate value of the resonance amplitude is greater than a predetermined reference voltage.

10 Claims, 8 Drawing Sheets

DRIVE APPARATUS FOR A DISPLAY PANEL

BACKGROUND OF THE INVENTION

1. Field of the Invention

The present invention relates to an apparatus for driving a display panel such as a plasma display panel (referred to as a "PDP") or an electroluminescence display panel (referred to as a "ELDP").

2. Description of the Related Art

In recent times, display devices (PDP or ELDP) are often used for a television set mounted on a wall (referred to as a "wall TV set"). In general, the PDP and ELDP include a number of capacitive light-emitting elements.

Referring to FIG. 1 of the accompanying drawings, a device having a PDP as a display panel is schematically illustrated.

In FIG. 1, the PDP 10 includes a number of row electrodes X1 to Xn and Y1 to Yn. One row electrode Xi and one row electrode Yi define a pair of row electrodes, which serve as one horizontal line of a screen (displayed image). The PDP 10 also includes a number of column electrode pairs Z1 to Zm that extend perpendicularly to the row electrodes Xi and Yi. One column electrode Zi defines one vertical line of the screen. A dielectric layer (not shown) and a discharge space (not shown) are provided between the neighboring column electrodes Zi. A discharge cell, which serves to form a pixel, is formed at every crossing of the row electrode Xi and Yi pairs and the column electrodes Zi.

Each discharge cell has two illumination conditions only. One condition is a light emitting condition. In this condition, electrical discharge occurs in the cell. The other condition is a non-emission condition. In this condition, electrical discharge does not occur. Accordingly, the discharge cell is only able to produce two levels of brightness, i.e., a least bright level (no emission) and a most bright level (emission). The discharge cells are the only light emission elements in the PDP 10.

However, if the PDP 10 is operated by a drive apparatus 100 using a subfield method, the PDP 10 can present many levels of brightness (gradation or half tone) in accordance with an input image signal. The subfield method converts the input image signal to a plurality of N-bit pixel data (each N-bit pixel data corresponds to each pixel of the input image signal), and divides a display period for one field. (frame) to N subfields (subframes) such that one field corresponds to one bit of the N-bit pixel data. The subfield method assigns the number of discharges to the subfields (i.e., determines how many times each subfield should discharge) in accordance with the weights given to the subfields. As a result, the subfields are selectively caused to discharge (emit light) on the basis of the input image signal. The total number of discharges occurring in the subfields creates the halftone brightness for the one field. Thus, the display device can present various brightness levels in accordance with the input image signal.

One of subfield methods to drive the PDP is a selective light-extinction addressing method.

The selective light-extinction addressing method will be briefly described with reference to FIG. 2 of the accompanying drawings. The PDP 10 and the drive apparatus 100 shown in FIG. 1 are used here. In order to create desired half tone brightness, the drive apparatus 100 applies drive pulses to the row and column electrodes Xi, Yi and Zi of the PDP 10 in one subfield, based on the timing chart shown in FIG. 2.

Firstly, the drive 100 simultaneously applies a negative reset pulse RPx to the row electrodes X1 to Xn and a positive reset pulse RPy to the row electrodes Y1 to Yn. This is called "simultaneous resetting process Rc". In response to the reset pulses RPx and RPy, all discharge cells in the PDP 10 discharge for resetting. As a result, a certain amount of wall charge is equally formed in each of the discharge cells. Accordingly, all the discharge cells are initialized to a light-emitting condition.

Subsequently, the drive apparatus 100 converts the input image signal to, for example, 8-bit pixel data for each pixel. The drive apparatus 100 divides the 8-bit pixel data to eight portions, which correspond to eight digits of the 8-bit pixel data respectively, to obtain pixel data bits, and generates pixel data pulses having pulse voltages corresponding to logic levels of the pixel data bits. For example, when the pixel data bit has a value "1" (logic level "1"), the drive apparatus 100 generates a pixel data pulse having a high voltage. When the pixel data bit has a value "0" (logic level "0"), the drive apparatus 100 generates a pixel data pulse having a low voltage (zero volt). As shown in FIG. 2, the drive apparatus 100 applies a group of pixel data pulses DP11-1*m*, DP21-2*m*, DP31-3*m*, . . . , DPn1-nm successively to the column electrodes Z1 to Zm. Each group of pixel data pulses is applied to one horizontal line of the screen. The one screen has n horizontal lines and m vertical lines (FIG. 1), and the pixel data pulses DP11-DPnm are grouped to n groups for the n horizontal lines. The drive apparatus 100 then generates scanning pulses SP, as shown in FIG. 2, and applies successively the scanning pulses SP to the row electrodes Y1 to Yn when the drive apparatus 100 applies the above-mentioned pixel data pulse groups DP. This is a pixel data writing process Wc. As a result, the discharge cells located at crossing points of the scanning-pulse-applied row electrodes Yi and the high-voltage pixel-data-pulse-applied column electrodes Zi are only caused to discharge (selective light-extinction discharge or selective elimination discharge). Therefore, the wall charges remaining in these discharge cells are eliminated. The discharge cells, which are initialized to the light emitting condition in the simultaneous resetting process Rc, are shifted to a no light emitting condition. On the other hand, other discharge cells, to which the scanning pulse PS is applied and the low voltage pixel data pulse DP is applied, do not undergo the selective light-extinction discharge. Thus, these discharge cells remain in the light emitting condition as they are initialized in the simultaneous resetting process Rc.

The drive apparatus 100 repeatedly applies the sustaining pulses IPx of positive polarity to the row electrodes X1 to Xn as shown in FIG. 2. When the drive apparatus 100 does not apply the sustaining pulses IPx to the row electrodes X1 to Xn, the drive apparatus 100 repeatedly applies the sustaining pulses IPy of the positive polarity to the row electrodes Y1 to Yn. This process is referred to as "light emission sustaining process Ic". In the light emission sustaining process Ic, those discharge cells in which the wall charge remains, i.e., the discharge cells in the light emitting condition, only discharge every time the sustaining pulses IPx and IPy are alternately applied (light-emission sustaining discharge). In other words, those discharge cells which are set to the light emitting condition in the pixel data writing process Wc are only caused to repeat the light emission by the light-emission sustaining discharge. How many times the light-emission sustaining discharge should be repeated is determined in accordance with the weight attached to the subfield concerned. Therefore, these discharge cells maintain the light emitting condition. How many times the sustaining pulses IPx and IPy are applied is previously determined, based on the weights of the respective subfields.

Then, the drive apparatus 100 applies light-extinction pulses EP to the row electrodes X1 to Xn, as shown in FIG. 2 (light extinction process E). As a result, all the discharge cells simultaneously discharge for light extinction, whereby the wall charge remaining in the discharge cells is eliminated.

By executing a series of the above described processes a plurality of times in each of the fields, the PDP 10 presents halftone brightness that corresponds to a total number of light-sustaining discharge caused in the processes Ic of all the subfields of the field concerned.

In the pixel data writing process Wc as shown in FIG. 2, the scanning pulses SP are sequentially applied to the row electrodes Y1 to Yn so that the pixel data is written into the discharge cells for each horizontal line of the screen. Since the light emitting elements (discharge cells) of the PDP 10 are the capacitive light emitting elements, charge/discharge is caused in each of the discharge cells in each horizontal line of the screen every time the scanning pulse SP is applied to that horizontal line. In addition, since the pixel data pulse DP is applied to one column electrode Z while the scanning pulse is applied, those discharge cells which belong to this column electrode Z (i.e., the discharge cells to which no pixel data should be written) should undergo the charging/discharging. Therefore, a considerable amount of electrical power is consumed when the pixel data writing process is performed.

SUMMARY OF THE INVENTION

An object of the present invention is to provide a drive apparatus for a display panel device, that can reduce power consumption during a pixel data writing process.

According to one aspect of the present invention, there is provided a drive apparatus for driving a display panel in response to an input image signal. The display panel includes a plurality of row electrodes, a plurality of column electrodes crossing the row electrodes, and a plurality of capacitive light-emitting elements at crossing portions of the row and column electrodes. The drive apparatus includes a column electrode driver for applying a pixel data pulse to each of the column electrodes. The pixel data pulse has a pulse voltage corresponding to pixel data derived from the input image signal. The column electrode driver includes a power source circuit for generating a resonance pulse power source voltage having a predetermined resonance amplitude, and for applying the resonance pulse power source voltage to a power source line. The column electrode driver also includes a pixel data pulse generator circuit for selectively connecting the column electrodes with the power source line based on the pixel data, to apply the pixel data pulse to the column electrodes. The column electrode driver also includes a DC drive prevention circuit for forcibly grounding the power source line while the resonance pulse power source voltage is dropping, when an intermediate value of the resonance pulse power source voltage (intermediate value of the resonance amplitude) is greater than a predetermined reference voltage.

The resonance pulse power source voltage having the predetermined resonance amplitude is applied on the power source line. The column electrodes of the display panel are selectively connected to the power source line based on the pixel data. As a result, the pixel data pulses are prepared. When the intermediate value of the resonance amplitude of the resonance pulse power source voltage becomes greater than the predetermined reference voltage, the power source line is grounded during the resonance pulse power source voltage dropping period.

Consequently, it is possible to avoid the DC drive due to the charge accumulated in the display panel, and to reduce an amount of a current produced upon charge and discharge caused by resonance. Thus, wasted electrical power is reduced.

According to a second aspect of the present invention, there is provided another apparatus for driving a display panel in response to an input image signal. The display panel includes a plurality of row electrodes, a plurality of column electrodes crossing the row electrodes, and a plurality of capacitive light-emitting elements at crossing portions of the row and column electrodes. The drive apparatus includes a column electrode driver for applying a pixel data pulse to each of the column electrodes. The pixel data pulse has a pulse voltage corresponding to pixel data derived from the input image signal. The column electrode driver includes a power source circuit for generating a resonance pulse power source voltage having a predetermined resonance amplitude, and for applying the resonance pulse power source voltage to a power source line. The column electrode driver also includes a pixel data pulse generator circuit for selectively connecting the column electrodes with the power source line based on the pixel data, to apply the pixel data pulse to the column electrodes. The column electrode driver also includes a DC drive prevention circuit for forcibly grounding the power source line while the resonance pulse power source voltage is dropping, when the input image signal is a graphics image signal (e.g., a picture, a design, a diagram, a graph and a chart) and an intermediate value of the resonance pulse power source voltage is greater than a predetermined reference voltage.

According to a third aspect of the present invention, there is provided a still another apparatus for driving a display panel in response to an input image signal. The display panel includes a plurality of row electrodes, a plurality of column electrodes crossing the row electrodes, and a plurality of capacitive light-emitting elements at crossing portions of the row and column electrodes. The row electrodes define horizontal lines of a screen of the display panel and the column electrodes define vertical lines of the screen of the display panel. The drive apparatus includes a column electrode driver for applying a pixel data pulse to each of the column electrodes. The pixel data pulse has a pulse voltage corresponding to pixel data derived from the input image signal. The column electrode driver includes a power source circuit for generating a resonance pulse power source voltage having a predetermined resonance amplitude, and for applying the resonance pulse power source voltage to a power source line. The column electrode driver also includes a pixel data pulse generator circuit for selectively connecting the column electrodes with the power source line based on the pixel data, to apply the pixel data pulse to the column electrodes. The column electrode driver further includes a DC drive prevention circuit for forcibly grounding the power source line while the resonance pulse power source voltage is dropping, when the pixel data of adjacent horizontal lines of the display panel screen have strong correlation with each other for most of the vertical lines of the display panel screen, and the pixel data of adjacent horizontal lines have weak correlation with each other for some of the vertical lines.

DETAILED DESCRIPTION OF THE INVENTION

Embodiments of the present invention will be described with reference to the accompanying drawings.

Figure 3:
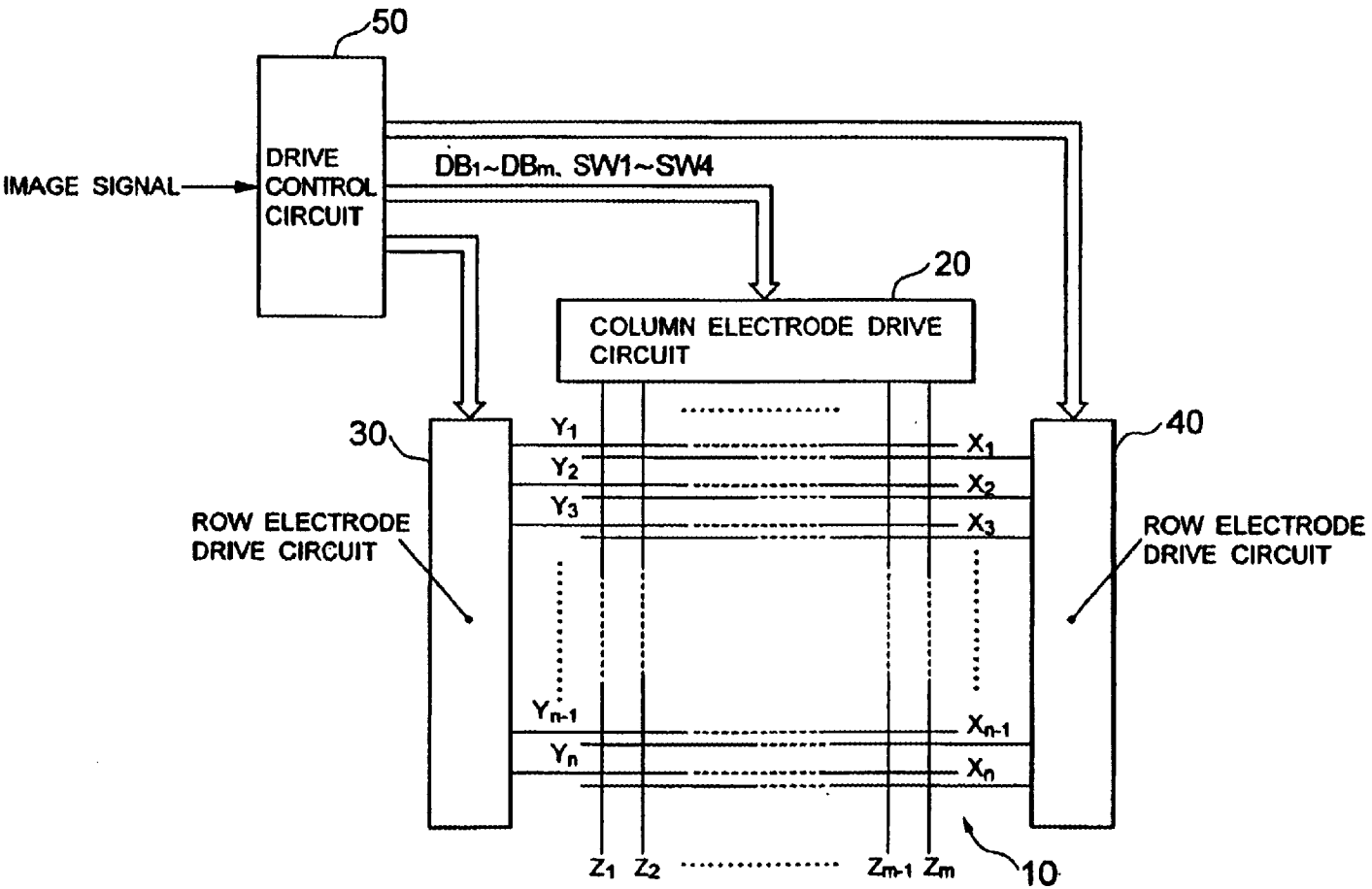
FIG. 3 illustrates a schematic diagram of a PDP device including a display panel driving apparatus according to one embodiment of the present invention.

Referring first to FIG. 3, a PDP device 10 includes a plurality of row electrodes X1 to Xn and a plurality of row electrodes Y1 to Yn. One row electrode Xi and one row electrode Yi define a pair of row electrodes, which serves as one horizontal line of a display screen (image displayed in a screen). The screen has n horizontal lines. The PDP 10 also includes a plurality of column electrodes Zi to Zm that extend perpendicularly to the row electrode pairs Xi and Yi. One column electrode Zi defines one vertical line of the screen so that the screen has m vertical lines. A dielectric layer (not shown) and a discharge space (not shown) are provided between neighboring column electrodes Zi. A discharge cell, which serves to form a pixel, is formed at each of the crossing points of the row electrode pairs Xi and Yi and the column electrodes Zi.

Figure 1:
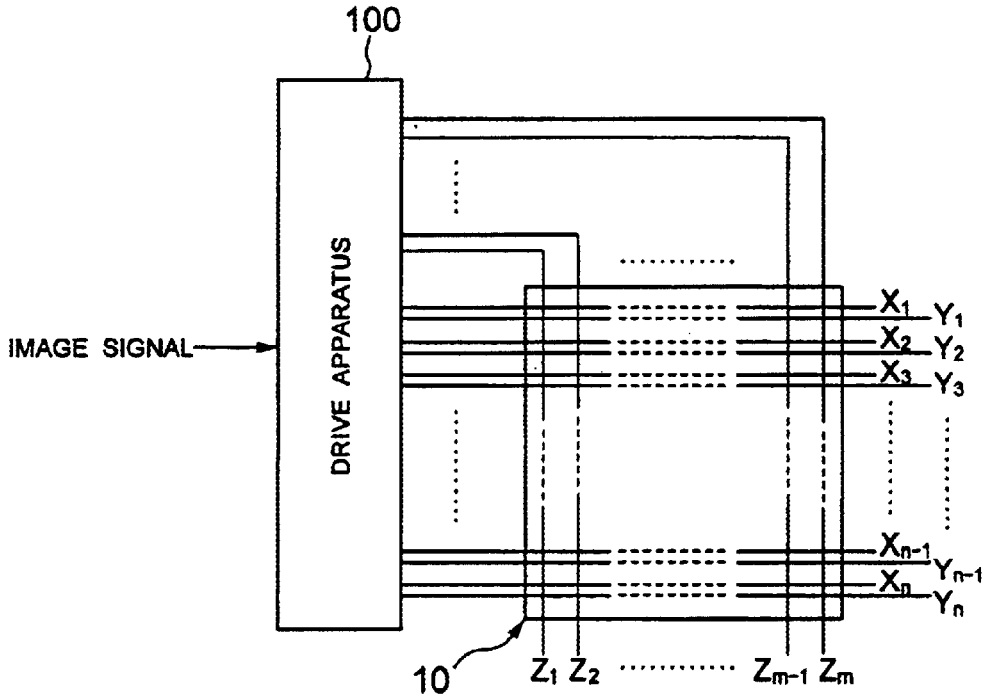
FIG. 1 schematically illustrates a structure of a PDP device.
Figure 2:
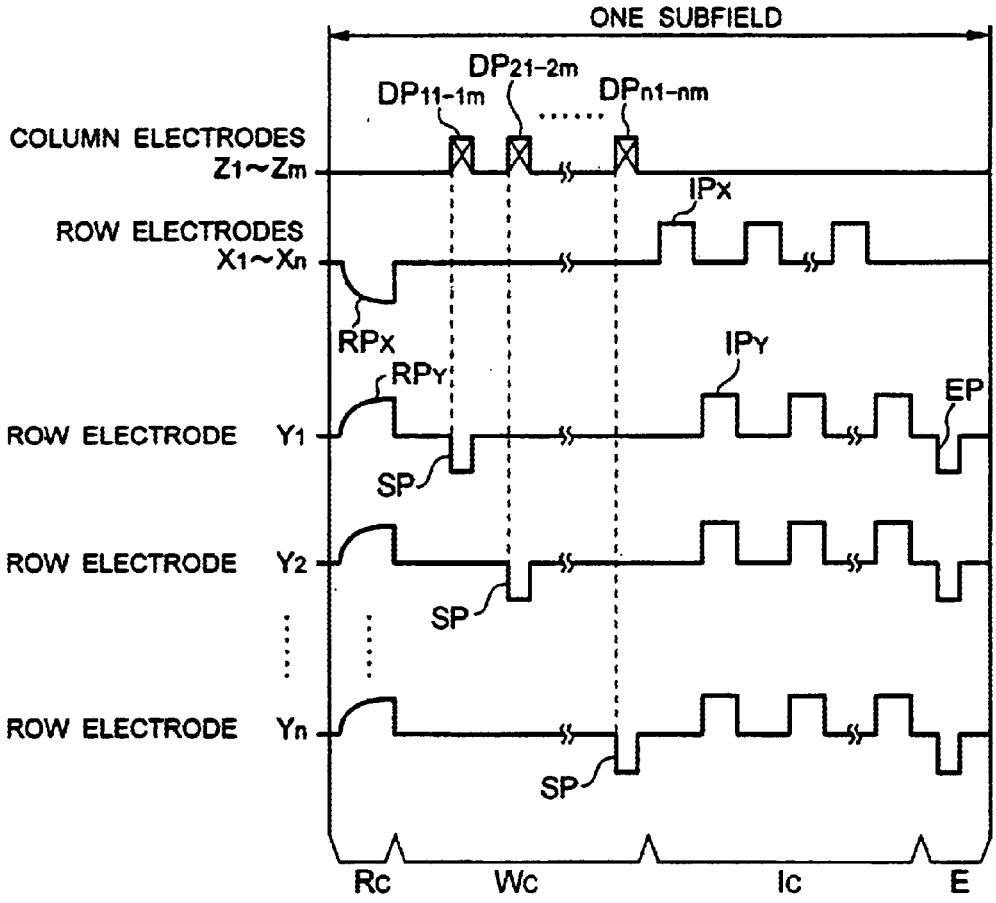
FIG. 2 illustrates a timing chart of drive pulse application to the PDP device shown in FIG. 1 in one subfield.

The PDP 10 is connected to a drive control circuit 50 via two row electrode drive circuits 30 and 40 and a column electrode drive circuit 20. An image signal (video signal) is input to the drive control circuit 50. The drive control circuit 50 produces various timing signals to generate reset pulses RPx and RPy, scanning pulses SP, and light-emission sustaining pulses IPx and IPy, as shown in FIG. 2, and supplies the timing signals to the row electrode driving circuits 30 and 40. The row electrode driving circuit 30 prepares the reset pulses RPx and light-emission sustaining pulses IPx in response to the timing signals applied to the driving circuit 30, and applies the reset pulses and light-emission sustaining pulses to the row electrodes X1 to Xn of the PDP 10 at the timing shown in FIG. 2. The row electrode driving circuit 40 prepares the reset pulses RPy, scanning pulses SP, light-emission sustaining pulses IPy and light-extinction pulses EP in response to the timing signals applied to the driving circuit 40 from the control circuit 50, and applies these pulses to the row electrodes Y1 to Yn of the PDP 10 at the timing shown in FIG. 2.

The drive control circuit 50 converts the-input image signal to pixel data of, for example, eight bits for each pixel. The drive control circuit 50 then divides the 8-bit pixel data to eight digit portions to obtain pixel data bits. In the pixel data writing process Wc for each subfield as shown in FIG. 2, the drive control circuit 50 supplies pixel data bits DB1 to DBm for one horizontal line of the screen successively to the column electrode drive circuit 20. The pixel data bits DB1 to DBm correspond to the column electrodes Z1 to Zm of the PDP 10.

Figures 4, 4A, 4B:
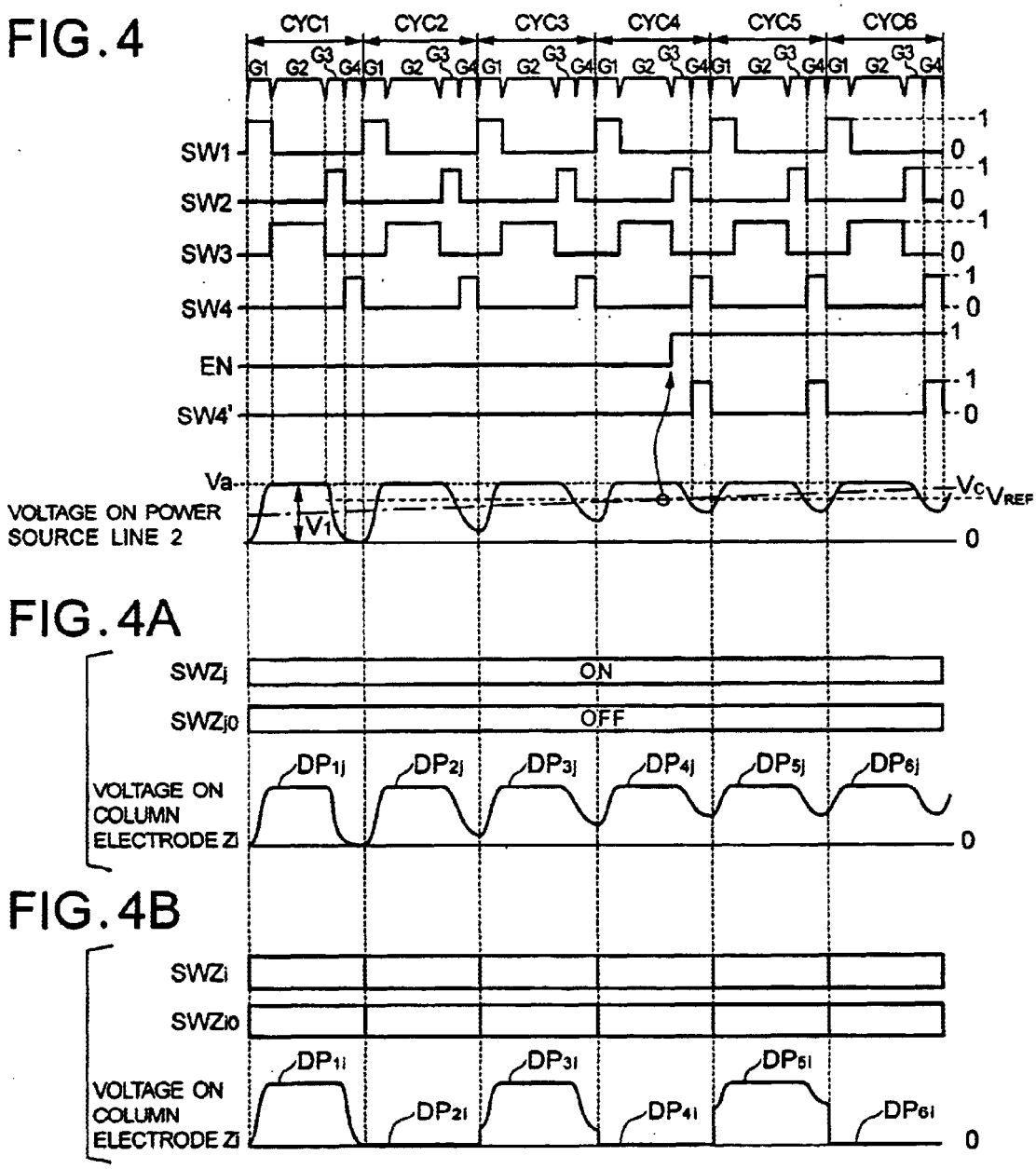
FIG. 4 illustrates operations of various elements in a column electrode driver circuit incorporated in the drive apparatus shown in FIG. 3.
FIG. 4A illustrates a pixel data pulse applied to a column electrode of the PDP device.
FIG. 4B illustrates another pixel data pulse applied to the column electrode of the PDP device under a different condition.

During the pixel data writing process Wc, the drive control circuit 50 produces switching signals SW1 to SW4 as shown in FIG. 4, and supplies the switching signals SW1 to SW4 to the column electrode drive circuit 20. Each switching signal has a logic level "1" or "0". Specifically, the drive control circuit 50 produces the switching signals having the different logic levels as shown below:

In a first drive process G1, SW1=1, SW2=0, SW3=0 and SW4=0.

In a second drive process G2, SW1=0, SW2=0, SW3=1 and SW4=0.

In a third drive process G3, SW1=0, SW2=1, SW3=0 and SW4=0.

In a fourth drive process G4, SW1=0, SW2=0, SW3=0

The first to fourth drive processes G1 to G4 define one cycle. The drive control circuit 50 reiterates the cycle (G1 to G4) to repeatedly supply the switching signals SW1 to SW4, which change their logic values as mentioned above, to the column electrode drive circuit 20.

Figure 5:
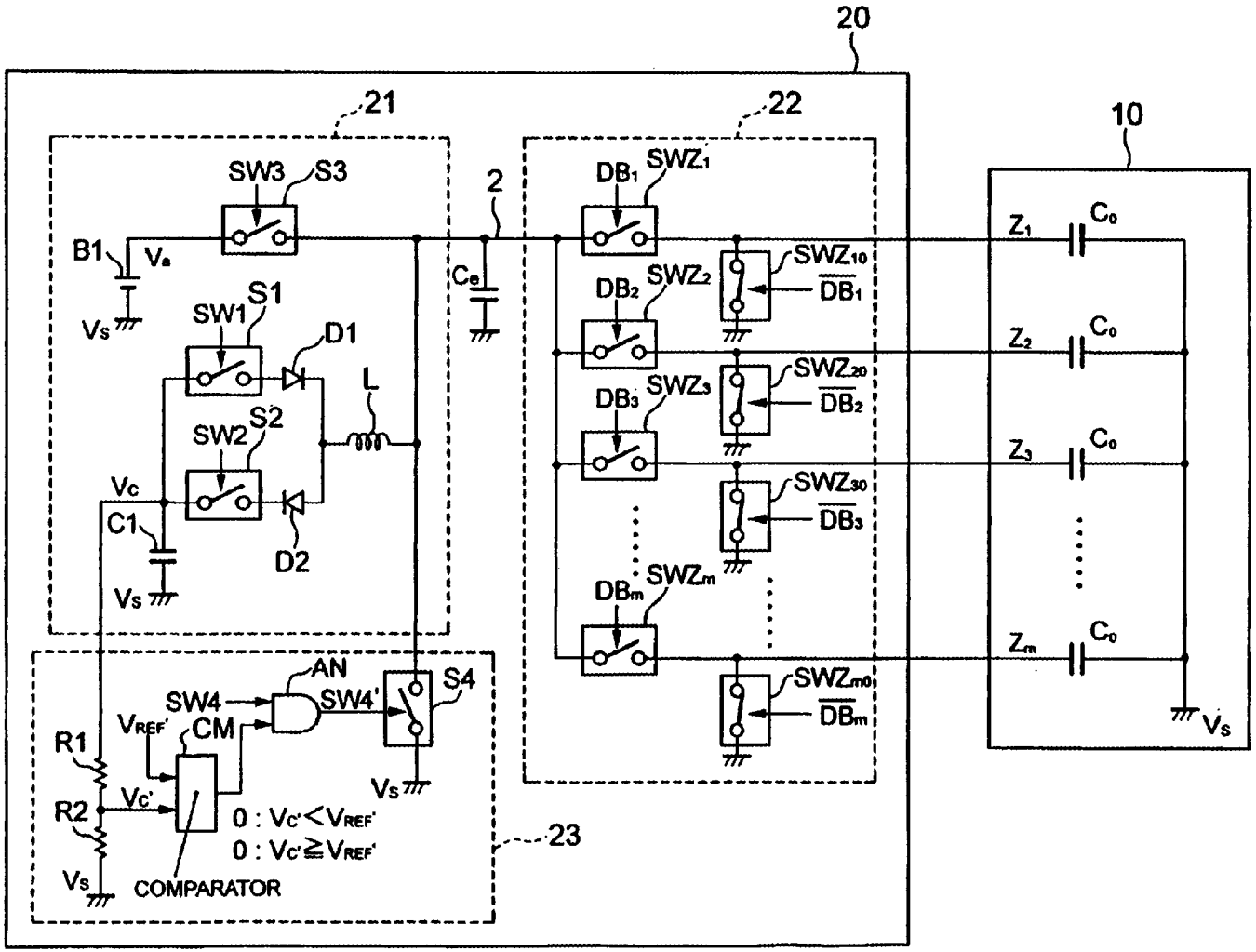
FIG. 5 illustrates an inside structure of the column electrode driver circuit.

Referring to FIG. 5, an inner structure of the column electrode drive circuit 20 is illustrated.

As shown in FIG. 5, the column electrode drive circuit 20 includes a power source circuit 21 that applies a resonance pulse source voltage onto a power source line 2, a pixel data pulse generating circuit 22 that generates a pixel data pulse based on the resonance pulse source voltage, and a DC drive prohibition circuit 23. The resonance pulse has a predetermined amplitude. The power source line 2 extends to the power source circuit 21 and the pixel data pulse generating circuit 22. The power source line 2 extending to the power source circuit 21 branches to the DC drive prohibition circuit 23.

A switching element S1 in the power source circuit 21 is in an off condition when the switching signal SW1 having the logic level 0 is supplied from the drive control circuit 50. On the other hand, when the logic level of the switching signal SW1 is 1, the switching element S1 is turned on (i.e., becomes an on condition) and applies a voltage arising at one end of a capacitor C1 on the power source line 2 via a diode D1 and a coil L. The other end of the capacitor C1 is connected (grounded) to a ground voltage Vs of the PDP 10. A second switching element S2 is in an off condition when the switching signal SW2 having the logic level 0 is supplied from the drive control circuit 50. When the logic level of the switching signal SW2 becomes 1, the switching element S2 is turned on and applies the voltage of the power source line 2 on the non-grounded end of the capacitor C1 via a diode D2 and the coil L. In this situation, the capacitor C1 is charged by the voltage on the power source line 2. A third switching element S3 is in an off condition when the switching signal SW3 having the logic level 0 is supplied from the drive control circuit 50. When the logic level of the switching signal SW3 becomes 1, the switching element S3 is turned on and applies a power source voltage Va of a DC power source B1 on the power source line 2. A negative terminal of the DC power source B1 is connected (grounded) to the PDP ground voltage Vs.

According to the above described operation of the power source circuit 21, the resonance pulse power source voltage having the resonance amplitude V1, up to the power source voltage Va, is applied to the power source line 2.

In the pixel data pulse generating circuit 22, there are provided switching elements SWZ1 to SWZm and SWZ10 and SWZm0, which are independently turned on and off in accordance with one-horizontal-line's worth of pixel data bits DB1 to DBm supplied from the drive control circuit 50. The one horizontal line's worth of pixel data bits are m pixel data bits. Each of the switching elements SWZ1 to SWZm is turned on when the pixel data bit DB applied to the switching element has a logic level 1. When in the on condition, the switching elements SWZ1 to SWZm apply the resonance pulse power source voltage, given on the power source line 2, on the column electrodes Z1 to Zm of the PDP 10. Each of the switching elements SWZ10 to SWZm0 is turned on when the pixel data bit DB applied to the switching element has a logic level 0. When in the on condition, the switching elements SWZ10 to SWZm0 connect the column electrodes Z to the PDP ground voltage Vs.

Voltage dividing resistors R1 and R2 in the DC drive prevention circuit 23 divide an intermediate value Vc of the resonance amplitude V1 arising at the non-grounded end of the capacitor C1 by a predetermined ratio, thereby obtaining another intermediate voltage Vc'. The intermediate voltage Vc' is then supplied to a comparator CM so that the intermediate voltage Vc' is compared with a predetermined reference voltage Vref' in the comparator CM. Unless the intermediate voltage Vc' is smaller than the reference voltage Vref', the comparator CM produces an enable signal EN having a logic level 1. Otherwise, the comparator produces an enable signal EN having a logic level 0. The enable signal EN is supplied to an and gate AN. The reference voltage Vref' is a voltage, which is obtained by multiplying a reference voltage Vref by a prescribed value. The reference voltage Vref is a value between the power source voltage Va and half of the power source voltage Va. When the enable signal EN has a logic level 0, the AND gate AN supplies a switching signal SW4' having a logic level 0 to the switching element S4. On the other hand, when the enable signal EN has a logic level 1, the AND gate AN simply transfers the switching signal SW4, which is provided from the drive control circuit 50, to the switching element S4 as the switching signal SW4'. The switching element S4 is in an off condition when the logic level of the switching signal SW4' is 0. On the other hand, the switching element S4 is in an on condition when the logic level of the switching signal SW4' is 1. When the switching element S4 is in the on condition, the voltage on the power source line 2 is maintained to be the PDP grounding voltage Vs.

Now, the interior operation of the column electrode drive circuit 20 having the structure shown in FIG. 5 will be described with reference to FIGS. 4, 4A, 4B and 6.

FIG. 4B illustrates the pixel data pulses DP which are applied to the column electrode Zi when the string of the pixel data bits DB for the first to sixth rows (horizontal lines) of the PDP screen crossing the i'th column (vertical line) of the PDP screen is [1, 0, 1, 0, 1, 0].

Upon receiving the pixel data bits DB, the switching elements SWZi and SWZio of the pixel data pulse generator circuit 22 alternately take the on and off conditions, as shown in FIG. 4B.

Specifically, in the drive process G1, the switching element S1 of the three switching elements S1 to S3 in the power source circuit 21 is only turned on so that the charge stored at the capacitor C1 is released (discharged). In the first cycle CYC1, since the switching element SWZi is in the on condition, a discharge current created upon the discharge of the capacitor C1 flows into the column electrode Zi of the PDP 10 via the switching element S1, diode D1, coil L, power source line 2 and switching element SWZi. Consequently, a load capacitor Co associated with the column electrode Zi is charged. In addition, when the capacitor C1 discharges, the voltage on the power source line 2 gradually increases due to resonance of the coil L and load capacitor Co. As shown in FIG. 4, the voltage on the power source line 2 reaches a voltage Va, which is twice the voltage Vc at the non-grounded end of the capacitor C1. The gradual current increase on the power source line 2 becomes a front edge of the resonance pulse power source voltage. In the first cycle CYC1, as shown in FIG. 4B, the front edge of the resonance pulse power source voltage itself is a front edge of the pixel data pulse DP1*i*, which is applied to the column electrode Zi.

In the drive process G2, the switching element S3 of the three switching elements S1 to S3 in the power source circuit 21 is only turned on so that the DC voltage Va from the DC power source B1 is added to the power source line 2 via the switching element S3. The voltage Va defines a maximum voltage value of the resonance pulse power source voltage. In the first cycle CYC1, the maximum voltage value (voltage Va) of the resonance pulse power source voltage is a maximum voltage portion of the pixel data pulse DP1*i* which is applied to the column electrode Zi, as shown in FIG. 4. A current flows to the column electrode Zi of the PDP 10, and the load capacitor Co attached to the column electrode Zi is charged.

In the drive process G3, the switching element S2 of the three switching elements S1 to S3 in the power source circuit 21 is only turned on so that the load capacitor Co of the PDP 10 starts discharging. Upon discharge from the load capacitor Co, a current flows into the capacitor C1 through the column electrode Zi, switching element SWZi, power source line 2, coil L, diode D2 and switching element S2. Hence, the charge stored at the load capacitor Co of the PDP 10 is collected (recovered) by the capacitor C1 in the power source circuit 21. The voltage on the power source line 2 gradually decreases, as shown in FIG. 4, in accordance with a time constant determined by the coil L and load capacitor Co. The gradual voltage decrease on the power source line 2 becomes a rear edge of the resonance pulse power source voltage. In the first cycle CYC1, the rear edge of the resonance pulse power source voltage becomes a rear edge of the pixel data pulse DP1*i* which is applied to the column electrode Zi, as shown in FIG. 4B.

In the drive process G4, the switching signal SW4 having the logic level 1 from the drive control circuit 50 is supplied to the AND gate AN of the DC drive prevention circuit 23. It should be noted that in the drive process G4 of the first cycle CYC1, the intermediate value (voltage) Vc of the resonance amplitude V1 (indicated by the single-dot chain line) resulting from the voltage change on the power source line 2 (FIG. 4) is smaller than the reference voltage Vref (indicated by the broken line). Hence, the comparator CM of the DC drive prevention circuit 23 supplies the enable signal EN having logic level 0 to the AND gate AN. This turns off the switching element S4. In the drive process G4, therefore, the switching elements S1 to S3 of the power source circuit 21 and the switching element S4 of the DC drive prevention circuit 23 are all turned off, and the power source line 2 is brought into a floating condition.

The drive processes G1 to G4 are repeated in the second cycle CYC2 and subsequent cycles as well. The switching element SWZi is in the on condition during the first cycle CYC1, third cycle CYC3 and fifth cycle CYC5, so that the pixel data pulse DP1*i*, DP3*i* and DP5*i* are applied to the column electrode Zi during the first, third and fifth cycles, as shown in FIG. 4B. On the other hand, the switching element SWZi is in the off condition during the second cycle CYC2, fourth cycle CYC4 and sixth cycle CYC6. Therefore, the pixel data pulses DP2*i*, DP4*i* and DP6*i* for the second, fourth and sixth rows (horizontal lines) have the low voltage (zero voltage) and are applied to the column electrode Zi. In the even number cycle (second, fourth and sixth cycles), the switching element SWZio is in the on condition so that the charge remaining at the load capacitor Co of the PDP 10 is recovered through the column electrode Zi and the switching element SWZio. The column electrode Zi and the switching element SWZio form a current passage. Hence, when the second cycle CYC2 ends and the third cycle CYC3 starts, i.e., when the switching element SWZi changes from the off condition to the on condition, the voltage on the power source line 2 is substantially zero volt, as shown in FIG. 4.

When the pixel data bits DB for the first to sixth rows (horizontal lines) for many columns (vertical lines), except for the i'th column, are [1, 1, 1, 1, 1, 1], then the resonance amplitude V1 of the voltage on the power source line 2 gradually decreases, as shown in FIG. 4. Specifically, as depicted in FIG. 4A, the switching element SWZj is in the on condition and the switching element SWZjo is fixed in the off condition, so that no charge is recovered through the column electrode Zj and the switching element SWZjo, unlike the case of FIG. 4B. Therefore, the charge which is not recovered during the drive process G3 in each cycle CYC is gradually stored in the load capacitor Co of the PDP 10. As a result, the resonance pulse power source voltage applied to the power source line 2 maintains the maximum value Va while the resonance amplitude V1 is gradually decreasing. Hence, an amount of the current flowing due to the charging and discharging caused by the resonance is reduced. This means that wasted electrical power is reduced.

Figure 6:
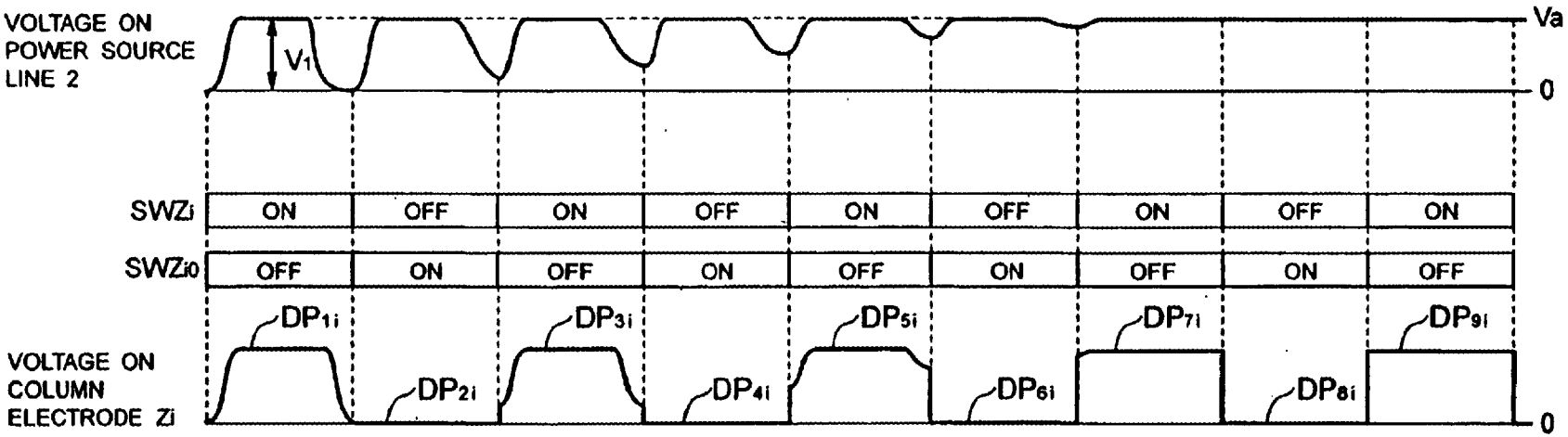
FIG. 6 illustrates a pixel data pulse applied during DC drive.

However, if this situation is maintained, the voltage on the power source line 2 is eventually fixed to the maximum voltage Va, as shown in FIG. 6. If the string of the pixel data bits DB for the seventh to thirteenth rows crossing the i'th column is [1, 0, 1, 0, 1, 0, 1], the switching elements SWZi and SWZio of the pixel data pulse generator circuit 22 alternately take the on and off conditions, as shown in FIG. 6. Accordingly, the switching element SWZi is in a so-called DC drive condition, which applies DC voltage Va of the power source line 2 to the column electrode Zi as long as the switching element SWZi is in the on condition. This wastes a great amount of electrical power.

In order to avoid such electrical waste (loss), the DC drive prevention circuit 23 shown in FIG. 5 is provided in the column electrode drive circuit 20.

Since the resonance amplitude V1 of the voltage on the power source line 2 is sufficiently large as shown in FIG. 4, the comparator CM in the DC drive prevention circuit 23 supplies the enable signal EN having a logic level 0 to the AND gate AN while the intermediate voltage Vc (indicated by the single-dot line in FIG. 4) is smaller than the reference voltage Vref (indicated by the broken line). When the intermediate voltage Vc is smaller than the reference voltage Vref, the switching element S4 of the DC drive prevention circuit 23 is not controlled by the switching signal SW4 so that the DC drive prevention is not performed. On the other hand, when the resonance amplitude V1 becomes smaller and the intermediate voltage Vc becomes greater than the reference voltage Vref, then the comparator CM feeds the enable signal EN having a logic level 1 to the AND gate AN. In response to the enable signal EN, the switching element S4 of the DC drive prevention circuit 23 operates under the control of the switching signal SW4, thereby starting the DC drive prevention.

As shown in FIG. 4, the switching element S4 is in the on condition while the voltage of the power source line 2 is dropping (i.e., during the drive process G4), so that the voltage of the power source line 2 is forcedly grounded to the PDP grounding voltage Vs during the drive process G4. Accordingly, part of the charge accumulated in the load capacitor Co of the PDP 10 discharges, the reduction of the resonance amplitude V1 is suppressed, and the DC drive shown in FIG. 6 is prevented. Consequently, even if an image signal which represents a special graphics, picture and design and which has the pixel data bit string 1, 0, 1, 0, 1, 0, . . . for the rows crossing a certain column is supplied to the drive control circuit 50, a large amount of power loss can be prevented.

The DC drive prevention circuit 23 shown in FIG. 5 performs the DC drive prevention when the intermediate value Vc of the resonance amplitude V1 becomes greater than the reference voltage Vref. It should be noted, however, that the DC drive prevention circuit 23 may operate in a different manner. For instance, the DC drive prevention circuit 23 may start the DC drive prevention when a certain pixel data bit pattern. (e.g., the one mentioned above) is detected. This modification is illustrated in FIG. 7.

Figure 7:
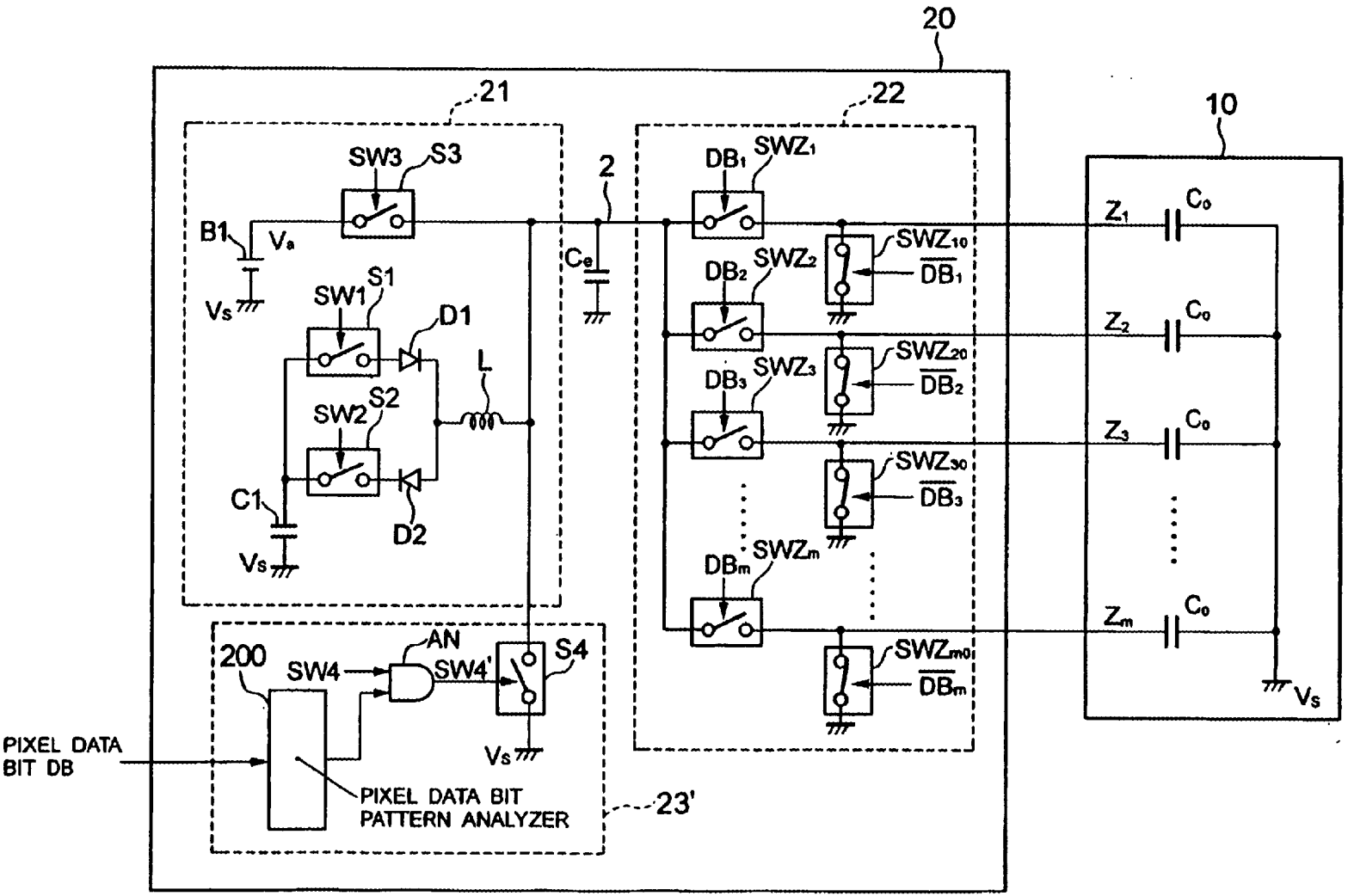
FIG. 7 illustrates a structure of a column electrode driver circuit according to a second embodiment of the present invention.

Some parts of the column electrode drive circuit 20 shown in FIG. 7 are similar to those of the column electrode drive circuit 20 shown in FIG. 5 so that similar reference numerals are used to designate similar parts in FIGS. 5 and 7. Specifically, the power source circuit 21 and pixel data pulse generating circuit 22 are identical in FIGS. 5 and 7. A DC drive prevention circuit 23' in FIG. 7 is different from the DC drive prevention circuit 23 in FIG. 5.

The DC drive prevention circuit 23' in the second embodiment (FIG. 7) utilizes a pixel data bit pattern analyzing circuit 200 in the place of the resistors R1 and R2 and the comparator CM used in the DC prevention circuit 23 of the first embodiment (FIG. 5). Since the AND gate AN and the switching element S4 used in the DC drive prevention circuit 23' operate in the same manner as those in the DC drive prevention circuit 23 shown in FIG. 5, the following description does not deal with the operation of the AND gate AN and the switching element S4.

The pixel data bit pattern analyzing circuit 200 supplies the enable signal EN having a logic level 1 to the AND gate AN only when the bit pattern of the pixel data bits DB1 to DBm satisfies the following conditions 1 and 2.

Condition 1: Pixel data bits (pixel data bit strings) for the rows have a pattern of strong correlation, such as 1, 1, 1, 1, 1, . . . , for most of the columns in the PDP 10.

Condition 2: Pixel data bits for the rows have a pattern of weak correlation, such as 1, 0, 1, 0, 1, 0, for some of the columns in the PDP 10.

When these two conditions are met, the DC drive prevention circuit 23' performs the DC drive prevention. The DC drive prevention circuit 23' prohibits the DC drive to the pixel data pulse generator circuit 22, like the DC drive prevention circuit 23 shown in FIG. 5.

When the input image signal is a TV signal, and the pixels have general correlation in the vertical (column) and horizontal (row) directions in one screen, it is not probable that the input image has a special graphics, picture and/or design. In view of this, an image signal type determination circuit may be added to the DC drive prevention circuit 23 of FIG. 5. This modification is illustrated in FIG. 8.

The circuit 300 for determining the type of the input image signal generates an enable signal having a logic level 0 when a TV signal, is input to the circuit 300, and generates an enable signal having a logic level 1 when a graphics image signal that possibly represents a special graphics, picture, design and/or chart (diagram) is input. The enable signal is then transmitted to an AND gate AN2. The comparator CM generates and transmits an enable signal EN having a logic level 0 to the AND gate AN2 when the voltage of the non-grounded end of the capacitor C1 (i.e., the intermediate value Vc of the resonance amplitude V1) is smaller than the reference voltage Vref. On the other hand, the comparator CM generates and transmits an enable signal EN having a logic level 1 to the AND gate AN2 when the intermediate voltage Vc is greater than the reference voltage Vref. Accordingly, only when the graphics image signal is input to the column electrode drive circuit 20 and the intermediate voltage Vc is greater than the reference voltage Vref, the switching element S4 is turned on upon switching of the switching element S3 from the on condition to the off condition (i.e., at the timing of the drive process G4), so as to forcibly ground the power source line 2 and achieve the DC drive prevention.

Figure 8:
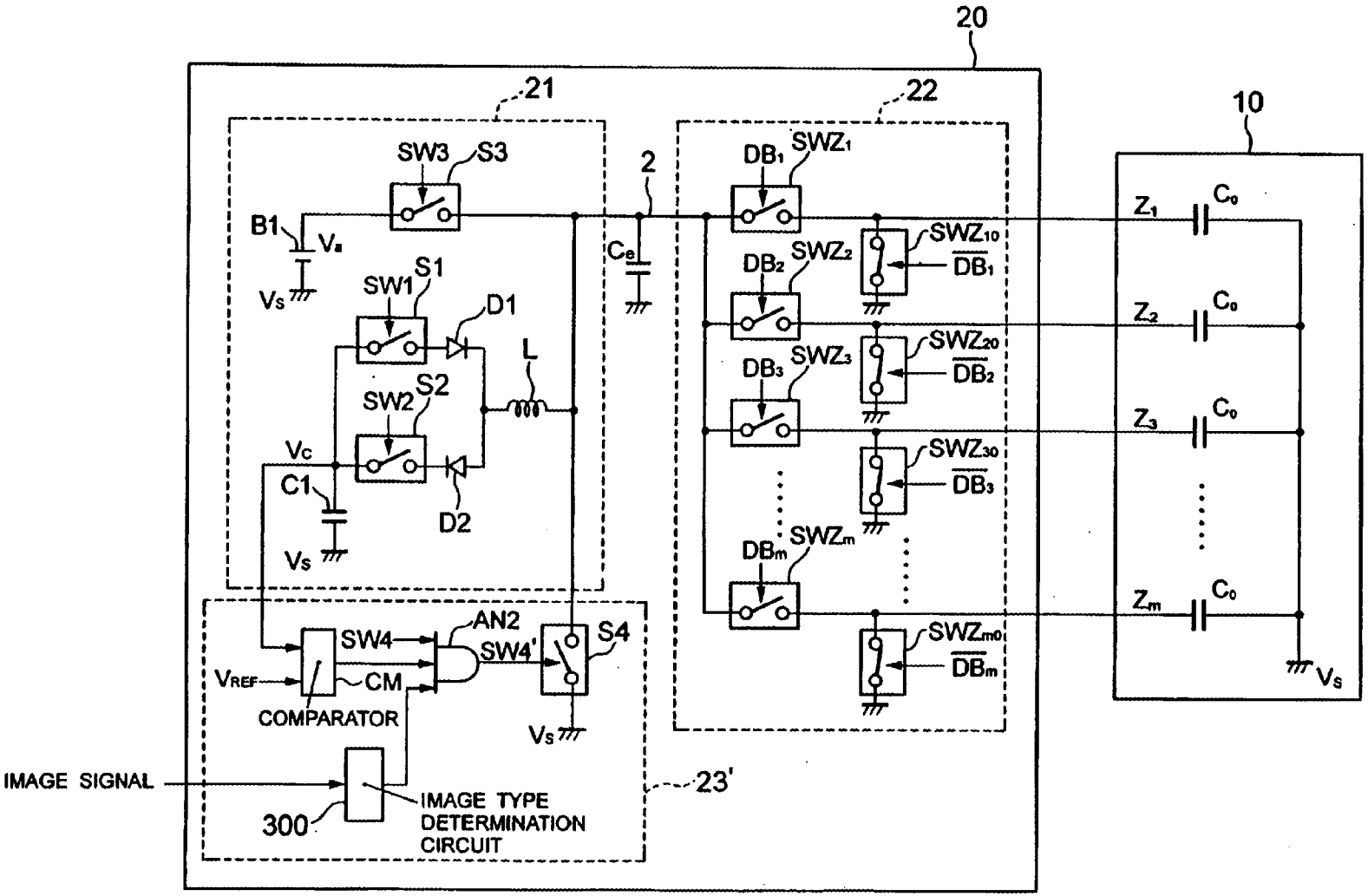
FIG. 8 illustrates a structure of a column electrode driver circuit according to a third embodiment of the present invention.

Similar reference numerals are used to designate similar parts in FIGS. 5, 7 and 8.

This application is based on a Japanese patent application No. 2002-98273, and the entire disclosure thereof is incorporated herein by reference.

What is claimed is:

1. A drive apparatus for driving a display panel in response to an input image signal, the display panel having a plurality of row electrodes, a plurality of column electrodes crossing the plurality of row electrodes, and a plurality of capacitive light-emitting elements at crossing portions of the plurality of row and column electrodes, the drive apparatus comprising:

a column electrode driver for applying a pixel data pulse to each of the plurality of column electrodes, the pixel data pulse having a pulse voltage corresponding to pixel data derived from the input image signal, the column electrode driver including:

a power source circuit for generating a resonance pulse power source voltage having a predetermined resonance amplitude, and for applying the resonance pulse power source voltage to a power source line, a pixel data pulse generator circuit for selectively connecting the column electrodes with the power source line based on the pixel data, to apply the pixel data pulse to the column electrodes, and a DC drive prevention circuit for forcibly grounding the power source line while the resonance pulse power source voltage is dropping, when an intermediate value of the resonance amplitude is greater than a predetermined reference voltage.

2. The drive apparatus according to claim 1, wherein the power source circuit includes a capacitor, a first switching element for selectively connecting one end of the capacitor with the power source line via a coil, a second switching element provided in parallel to the first switching element for selectively connecting the power source line with the one end of the capacitor via the coil, a third switching element for selectively applying a DC power source voltage on the power source line, and a power source drive controller circuit for sequentially turning on one of the first switching element, second switching element and third switching element in a predetermined order to cause the resonance pulse power source voltage to appear (arise) on the power source line.

3. The drive apparatus according to claim 2, wherein the DC drive prevention circuit includes a fourth switching element for selectively grounding the power source line, and a DC drive prevention control circuit which uses a voltage of the one end of the capacitor as the intermediate value to switch the fourth switching element from an off condition to an on condition upon switching of the third switching element from an on condition to an off condition, only when the intermediate value is greater than the reference voltage.

4. A drive apparatus for driving a display panel in response to an input image signal, the display panel having a plurality of row electrodes, a plurality of column electrodes crossing the plurality of row electrodes, and a plurality of capacitive light-emitting elements at crossing portions of the plurality of row and column electrodes, the drive apparatus comprising:

a column electrode driver for applying a pixel data pulse to each of the plurality of column electrodes, the pixel data pulse having a pulse voltage corresponding to pixel data derived from the input image signal, the column electrode driver including:

a power source circuit for generating a resonance pulse power source voltage having a predetermined resonance amplitude, and for applying the resonance pulse power source voltage to a power source line, a pixel data pulse generator circuit for selectively connecting the column electrodes with the power source line based on the pixel data, to apply the pixel data pulse to the column electrodes, and a DC drive prevention circuit for forcibly grounding the power source line while the resonance pulse power source voltage is dropping, when the input image signal is a graphics image signal and an intermediate value of the resonance amplitude is greater than a predetermined reference voltage.

5. The drive apparatus according to claim 4, wherein the graphics image signal represents at least one of a picture, a design, a diagram, a graph and a chart.

6. The drive apparatus according to claim 4, wherein the power source circuit includes a capacitor, a first switching element for selectively connecting one end of the capacitor with the power source line via a coil, a second switching element provided in parallel to the first switching element for selectively connecting the power source line with the one end of the capacitor via the coil, a third switching element for selectively applying a DC power source voltage on the power source line, and a power source drive controller circuit for sequentially turning on one of the first, second and third switching elements in a predetermined order to cause the resonance pulse power source voltage to appear on the power source line.

7. The drive apparatus according to claim 6, wherein a voltage of the one end of the capacitor is taken as the intermediate value, the DC drive prevention circuit includes a fourth switching element for selectively grounding the power source line, and a DC drive prevention control circuit for determining whether the input image signal is a television signal or the graphics signal, and for switching the fourth switching element from an off condition to an on condition upon switching of the third switching element from an on condition to an off condition, only when the intermediate value is greater than the reference voltage and the DC drive prevention control circuit determines that the input image signal is the graphics signal.

8. A drive apparatus for driving a display panel in response to an input image signal, the display panel having a plurality of row electrodes, a plurality of column electrodes crossing the plurality of row electrodes, and capacitive light-emitting elements at crossing portions of the plurality of row and column electrodes such that the plurality of row electrodes define horizontal lines of a screen of the display panel and the plurality of column electrodes define vertical lines of the screen of the display panel, the drive apparatus comprising:

a column electrode driver for applying a pixel data pulse to each of the plurality of column electrodes, the pixel data pulse having a pulse voltage corresponding to pixel data derived from the input image signal, the column electrode driver including:

a power source circuit for generating a resonance pulse power source voltage having a predetermined resonance amplitude, and for applying the resonance pulse power source voltage to a power source line, a pixel data pulse generator circuit for selectively connecting the column electrodes with the power source line based on the pixel data, to apply the pixel data pulse to the column electrodes, and a DC drive prevention circuit for forcibly grounding the power source line while the resonance pulse power source voltage is dropping, when the pixel data of adjacent horizontal lines of the screen of the display panel have strong correlation with each other for most of the vertical lines of the screen of the display panel, and the pixel data of adjacent horizontal lines have weak correlation with each other for some of the vertical lines.

9. The drive apparatus according to claim 8, wherein the power source circuit includes a capacitor, a first switching element for selectively connecting one end of the capacitor with the power source line via a coil, a second switching element provided in parallel to the first switching element for selectively connecting the power source line with the one end of the capacitor via the coil, a third switching element for selectively applying a DC power source voltage on the power source line, and a power source drive controller circuit for sequentially turning on one of the first, second and third switching elements in a predetermined order to cause the resonance pulse power source voltage to appear on the power source line.

10. The drive apparatus according to claim 9, wherein the DC drive prevention circuit includes a fourth switching element for selectively grounding the power source line, and a DC drive prevention control circuit for switching the fourth switching element from an off condition to an on condition upon switching of the third switching element from an on condition to an off condition, only when the pixel data of the adjacent horizontal lines of the screen have strong correlation with each other for most of the vertical lines of the screen, and the pixel data of the adjacent horizontal lines have weak correlation with each other for some of the vertical lines.

* * * * *